US009242129B2

(12) United States Patent
Edwards

(10) Patent No.: US 9,242,129 B2
(45) Date of Patent: Jan. 26, 2016

(54) MULTIPLE ORIENTATION PARTICULATE DISCHARGE VESSEL

(71) Applicant: TSM Corporation, Bartlett, TN (US)

(72) Inventor: Richard H. Edwards, Germantown, TN (US)

(73) Assignee: TSM Corporation, Bartlett, TN (US)

( * ) Notice: Subject to any disclaimer, the term of this patent is extended or adjusted under 35 U.S.C. 154(b) by 0 days.

(21) Appl. No.: 13/674,885

(22) Filed: Nov. 12, 2012

(65) Prior Publication Data

US 2014/0131056 A1 May 15, 2014

(51) Int. Cl.
*A62C 13/00* (2006.01)
*A62C 13/72* (2006.01)

(52) U.S. Cl.
CPC ..... *A62C 13/006* (2013.01); *A62C 13/72* (2013.01)

(58) Field of Classification Search
CPC ..... A62C 13/00; A62C 13/006; A62C 13/72
USPC ..... 169/72, 71, 77, 84, 28, 29, 46, 74; 222/635, 195; 406/146, 144, 137, 138, 406/134, 122; 280/740, 741
See application file for complete search history.

(56) References Cited

U.S. PATENT DOCUMENTS 1,638,729 A * 8/1927 Friedrich ..... 169/77
2,425,715 A * 8/1947 Barnes ..... 169/72
4,197,213 A * 4/1980 Pietz et al. ..... 252/372
5,335,940 A * 8/1994 Cuevas ..... 280/737
5,462,307 A * 10/1995 Webber et al. ..... 280/737
5,845,716 A * 12/1998 Birk ..... 169/85
5,992,528 A * 11/1999 Parkinson et al. ..... 169/6
6,702,033 B1 * 3/2004 Mitchell et al. ..... 169/85
7,703,471 B2 4/2010 Edwards
7,740,081 B2 6/2010 Edwards et al.
2007/0085311 A1 * 4/2007 Hofmann et al. ..... 280/739

OTHER PUBLICATIONS

Butz, James R.; Turchi, Craig S.; Kimball, Amanda; MC Kinnon, Thomas; Riedel, Edward; Fine-Water-Mist Multiple-Orientation-Discharge Fire Extinguisher, NASA Tech Briefs (Jan. 2010), p. 50, vol. 34 No. 1 (National Aeronautics and Space Administration (U.S.).

* cited by examiner

*Primary Examiner* — Arthur O Hall
*Assistant Examiner* — Chee-Chong Lee
(74) *Attorney, Agent, or Firm* — Walker, McKenzie & Walker, P.C.

(57) ABSTRACT

A multiple orientation particulate discharge apparatus including an outer vessel, having first and second ends, and an interior vessel forming a void and substantially sealed to the outer vessel proximate the first end. A single-action discharge valve selectively seals an outlet through the outer vessel. An outlet manifold spans the outlet and has a plurality of radial passageways that place the outlet in communication with the void. An inlet with an inflation valve is provided into the void through the outer vessel for filling the interior vessel with particulate and for pressurizing the interior and outer vessels. A plate proximate the second end has a plurality of angled bores and is interposed between the outer and interior vessels.

4 Claims, 4 Drawing Sheets

MULTIPLE ORIENTATION PARTICULATE DISCHARGE VESSEL

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to single-operation particulate discharge apparatus such as fire extinguishers and fire suppression apparatus, and in particular, to an apparatus for discharge of particulate under pressure such that the apparatus can be operated in multiple orientations.

2. Information Disclosure Statement

Pressurized vessels are often used for discharge of particulate such as fire suppression powders. However, prior art particulate discharge vessels do not perform well when inverted from their normal upright operating position, and frequently leave substantial particulate within the vessel.

Some prior art vessels for holding a fire extinguishing particulate and its pressurizing agent (typically, Nitrogen gas) include, in most cases, an internal siphon tube that draws the fire extinguishing material and nitrogen from the bottom of the pressurized vessel and discharges the mixture from the top. While such a prior art vessel is effective when operated in an upright position with the siphon tube extending into the bottom of the vessel and discharge being from the top of the vessel, such a prior art vessel will not work effectively when in the inverted position.

Another type of prior art pressure vessel has the discharge outlet at the bottom of its vessel, and can be effective to discharge more than 95% of its contents provided that the vessel is operated in its upright position such that discharge occurs from the discharge outlet at the bottom of the vessel. Such prior art solutions include Edwards, U.S. Pat. No. 7,703,471 (issued Apr. 27, 2010), fully included by reference herein, and Edwards et al., U.S. Pat. No. 7,740,081 (issued Jun. 22, 2010), also fully included by reference herein. Edwards, U.S. Pat. No. 7,703,471, discloses a single-action discharge valve that could preferably be used with the present invention. Edwards et al., U.S. Pat. No. 7,740,081, discloses use of a single-action discharge valve within a fire-extinguishing apparatus and the control circuitry therefor, as could be used with the present invention. However, these bottom-discharge prior art vessels are also ineffective when operated in an inverted position because substantial particulate remains within the vessel after the discharge cycle occurs.

Additionally, Butz, James R., et al., "Fine-Water-Mist Multiple-Orientation-Discharge Fire Extinguisher", *NASA Tech Briefs* (January 2010), p. 50, Vol. 34 No. 1 (National Aeronautics and Space Administration (U.S.), discloses a fine-water-mist multiple-orientation-discharge fire suppression device that can be used on spacecraft and airplanes in multiple orientations.

None of these references, either singly or in combination, discloses or suggests the present invention.

It is therefore desirable to provide a particulate discharge vessel that can operate effectively in multiple orientations, inverted, non-inverted, and horizontal, and that will discharge substantially all of the particulate within the vessel regardless of orientation.

BRIEF SUMMARY OF THE INVENTION

The present invention is a multiple orientation particulate discharge vessel for rapidly discharging particulate, such as fire-extinguishing chemical powder, from a pressurized vessel that can be used in multiple orientations.

The apparatus of the present invention includes an outer vessel, having first and second ends, and an interior vessel forming a void and substantially sealed to the outer vessel proximate the first end. A single-action discharge valve selectively seals an outlet through the outer vessel. An outlet manifold spans the outlet and has a plurality of radial passageways that place the outlet in communication with the void. An inlet with an inflation valve is provided into the void through the outer vessel for filling the interior vessel with particulate and for pressurizing the interior and outer vessels. A plate proximate the second end has a plurality of angled bores and is interposed between the outer and interior vessels.

It is an object of the present invention to provide a particulate discharge vessel that operates effectively in multiple orientations, inverted, non-inverted, and horizontal, and that effectively discharges more of the particulate from within the vessel than possible with prior art solutions when the vessel is inverted.

DETAILED DESCRIPTION OF THE INVENTION

Figure 1:
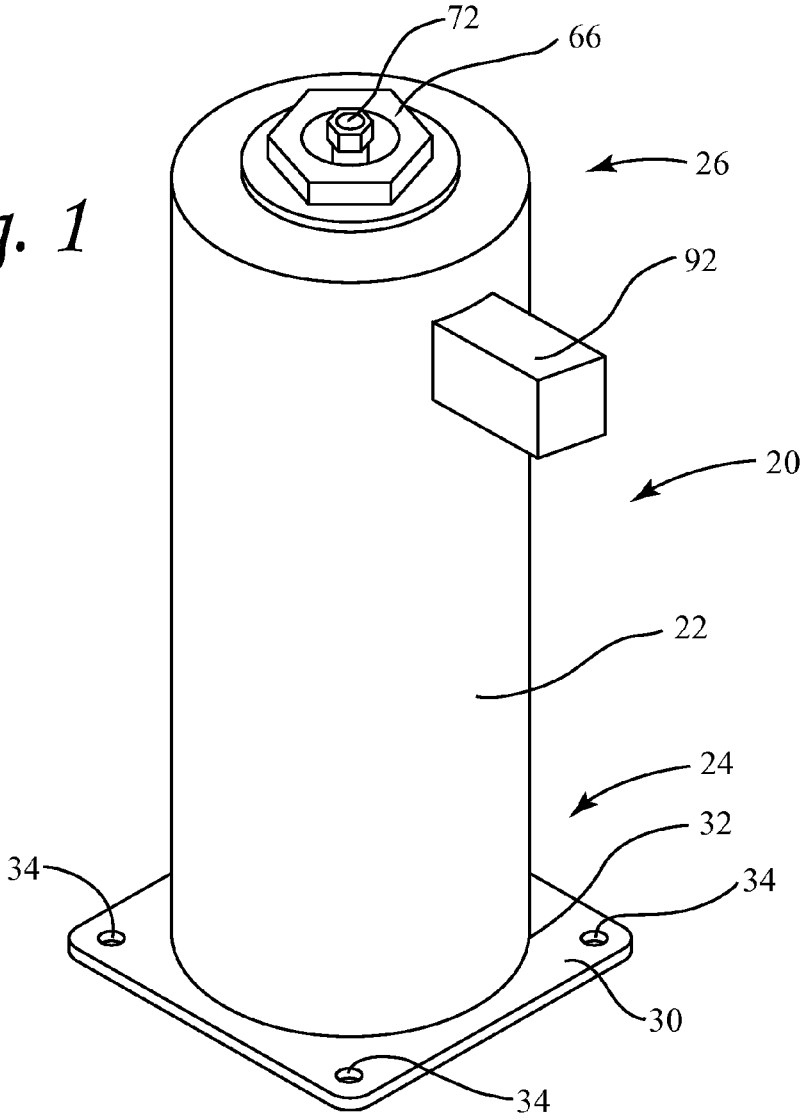
FIG. 1 is a perspective view of the present invention.

Referring to FIGS. 1-9, discharge apparatus 20 is seen to comprise a preferably cylindrical outer vessel 22 having a first end 24 and a second end 26, and a preferably cylindrical interior vessel 28 within outer vessel 22. Apparatus 20 preferably includes a base 30 sealing outer vessel 22 at first end 24 as by a circumferential weld 32 sealing base 30 to outer vessel 22. Apparatus 20 may be mounted in place as by screws or bolts, not shown, through holes 34 in base 30.

Interior vessel 28 forms a void 36 therewithin and is substantially sealed to outer vessel 22 proximate first end 24 as by being closely received at its lower end into a circular recess 38 within base 30. Outer vessel 22 has an outlet 40 through its first end 24 that is in communication with void 36.

A single-action discharge valve 42, preferably such as the single-action discharge valve disclosed in Edwards, U.S. Pat. No. 7,703,471 (issued Apr. 27, 2010), fully incorporated by reference herein, selectively seals outlet 40. Valve 42 may include, for example, a glass plate 44 that is broken by the impact of teeth 46 of valve 42 that are caused to reciprocate in a single-stroke action by an armature, so as to quickly and fully open outlet 40 for discharge of the contents of void 36.

Apparatus 20 further includes an outlet manifold 48 within interior vessel 28 and with outlet manifold 48 spanning outlet 40. Outlet manifold 48 includes a cap 50 and has a plurality of radially-directed passageways 52 interposed between cap 50 and first end 24, with radial passageways 52 causing outlet 40 to be in communication with void 36. Radial passageways 52 may be formed by milling a plurality of radial grooves 0.078 inch (0.198 cm) wide and 0.130 inch (0.330 cm) deep into manifold 48. Preferably, the sharp inwardly-pointing points of the separating walls 54 of radial passageways 52 are removed by machining a 1.125 inch (2.86 cm) centered counterbore 56 into manifold 48. Radial passageways 52 are preferably sized so that the total passageway cross-sectional area of all passageways 52 is not less than the cross-sectional area of outlet 40, and preferably 20% larger than the cross-sectional area of outlet 40, so that the escaping particulate and gas from within void 36 is not impeded as it passes through passageways 52 into outlet 40. Manifold 48 is preferably attached to first end 24 of outer vessel 22 as by screws 58 received into base 30 through holes 60 in manifold 48. Manifold 48 was found by testing to prevent dry particulate from piling up during discharge around the inside of interior vessel 28 at base 30 adjacent recess 38 by forcing the dry particulate to enter through passageways 52 by gas flowing radially inward and substantially parallel to base 30 at first end 24 during discharge, creating a turbulent flow at first end 24 that evacuates dry particulate adjacent the junction of interior vessel 28 with base 30.

Figure 2:
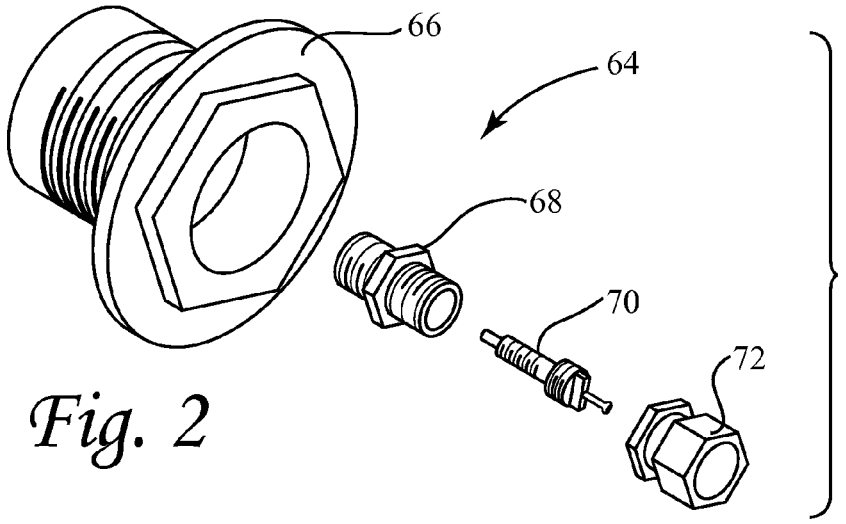
FIG. 2 is an exploded perspective view of the inlet fill valve showing the parts thereof.
Figure 3:
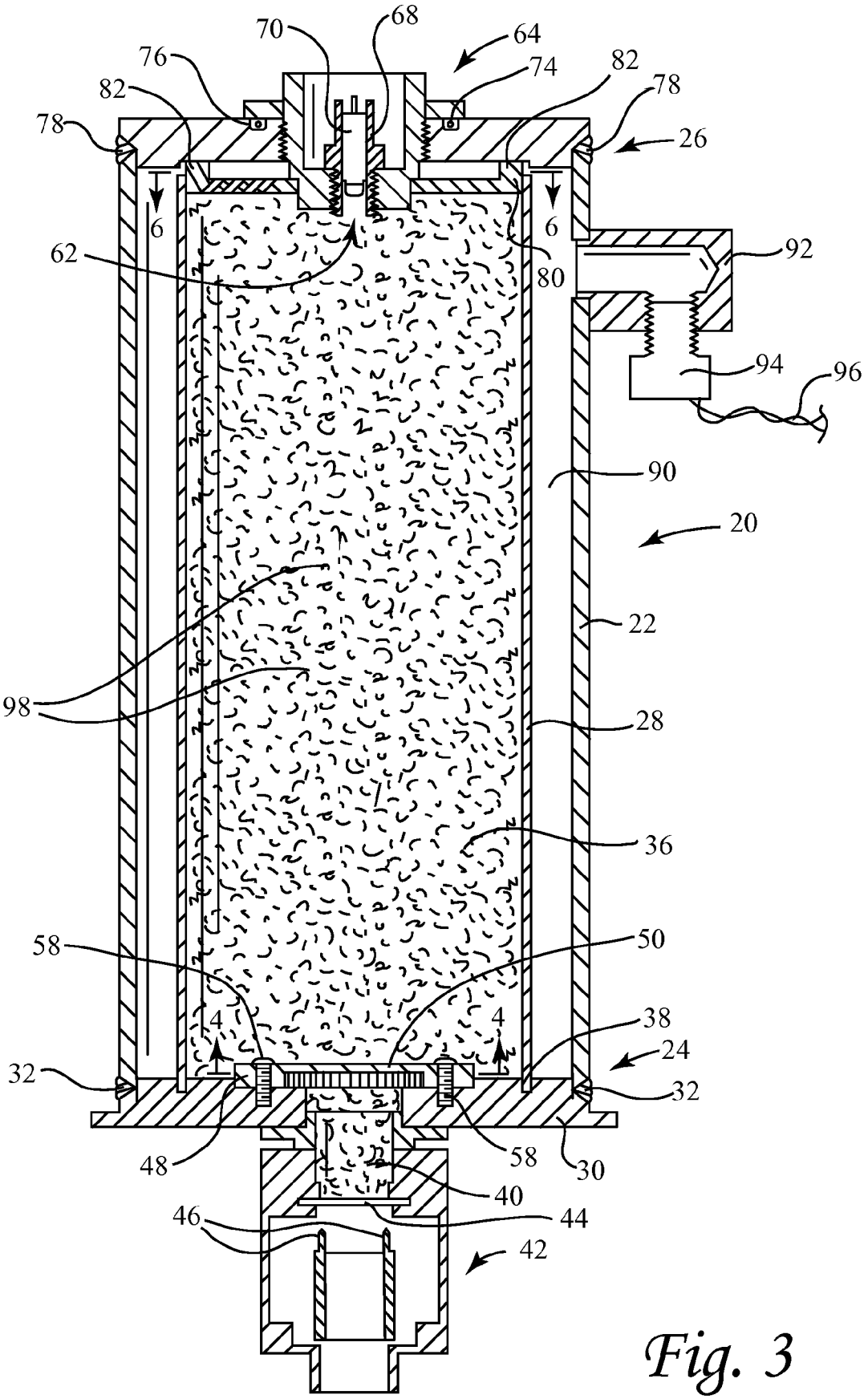
FIG. 3 is a cross-section view of the present invention, taken along a diameter of the apparatus.
Figure 4:
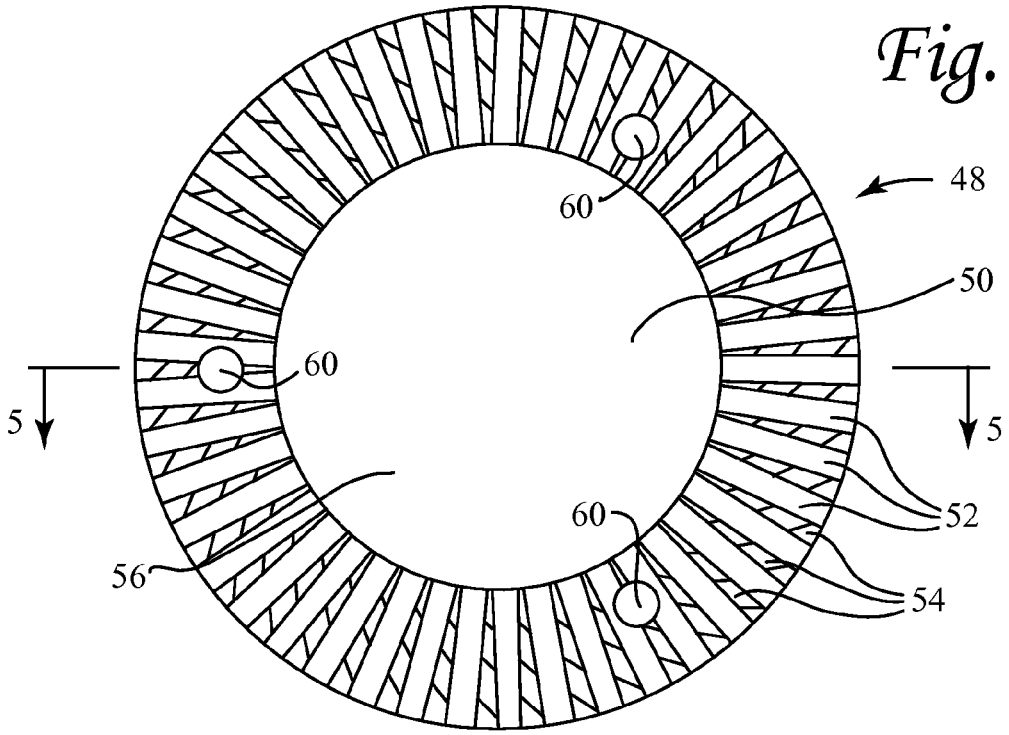
FIG. 4 is a upward-looking view of the outlet manifold of the present invention, taken substantially along the line 4-4 shown in FIG. 3.
Figure 5:
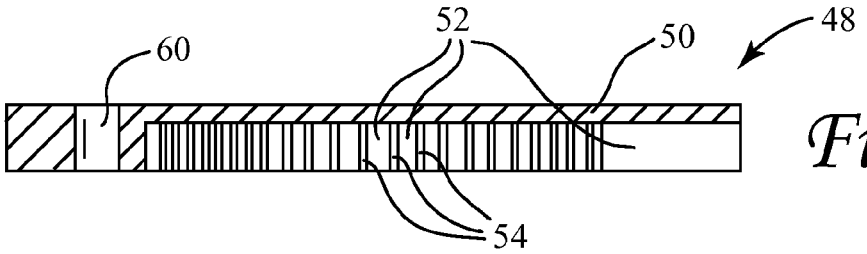
FIG. 5 is a sectional view of the outlet manifold of the present invention, taken substantially along the line 5-5 shown in FIG. 4.

Apparatus 20 further has an inlet 62 extending into void 36 through outer vessel 22, preferably axially located at second end 26. Inlet 62 is preferably threaded and a fill valve assembly 64, best seen in FIG. 2, is threadedly received into inlet 62 for selective sealing of inlet 62. Fill valve assembly 64 includes a fitting 66 into which is received a well-known Schrader valve body 68 holding a Schrader valve core 70. A valve cap 72 is preferably provided for covering and protecting valve core 70 after pressurizing the apparatus as hereinafter described. Fill valve assembly 64, when threadedly received into inlet 62, is preferably sealed to second end 26 as by a well-known O-ring 74 received into a recess 76 within second end 26. Outer vessel 22 is preferably sealed at second end 26 as by a circumferential weld 78.

Figure 6:
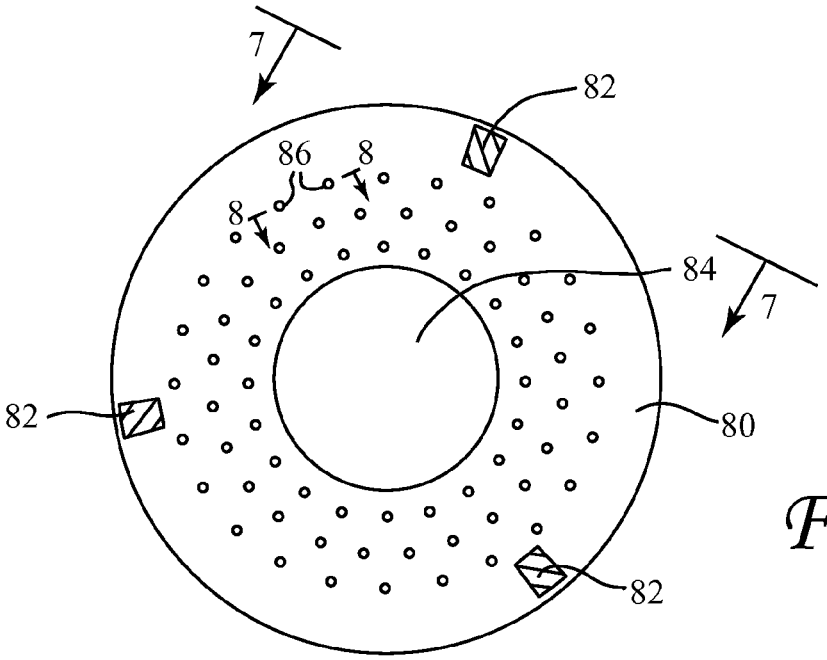
FIG. 6 is a downward-looking view of the plate proximate the second end of the outer vessel, taken substantially along the line 6-6 shown in FIG. 3.
Figure 7:
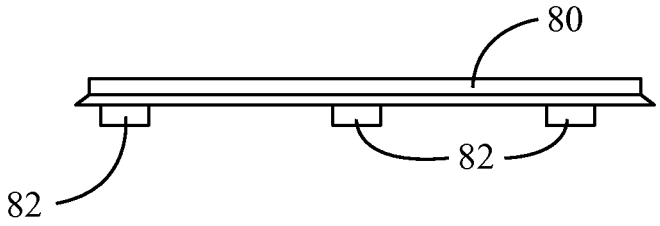
FIG. 7 is a side view of the plate of the present invention, taken substantially along the line 7-7 shown in FIG. 6.
Figure 8:
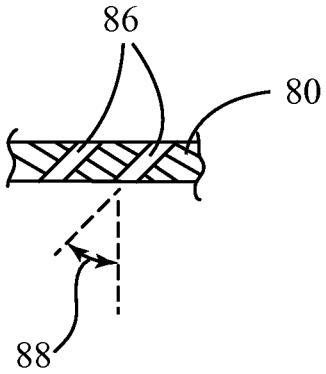
FIG. 8 is a partial sectional view of the plate of the present invention showing two of the angled bores through the plate, taken substantially along the line 8-8 shown in FIG. 6.
Figure 9:
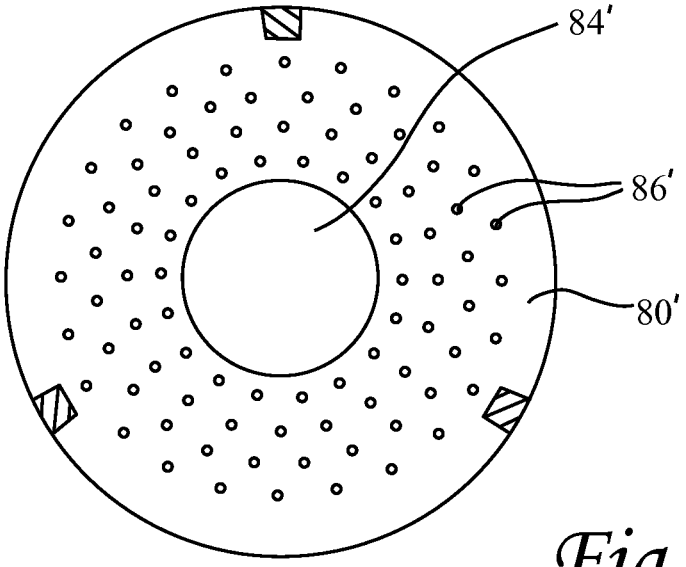
FIG. 9 shows an alternate embodiment of the plate of the present invention, similar to the view shown in FIG. 6, in which the plate has an increased number of angled bores.

Apparatus 20 further comprises a plate 80 proximate second end 26 and interposed between outer vessel 22 and interior vessel 28. Plate 80 is spaced from second end 26 by a plurality of legs 82 and has a central hole 84 (1.25 inch (3.175 cm) in diameter) through which fill valve assembly 64 is closely received. Plate 80 has a plurality of bores 86 therethrough, with each bore 86 being at an acute angle 88, preferably 45 degrees, with respect to plate 80 as best seen in FIG. 8, preferably with bores 86 being spaced about the perimeters of a plurality of concentric circles as shown in FIG. 6. Angled bores 86 also preferably extend through plate 80 at a tangent to their respective concentric circle such that they cause the pressurized gas passing from the space 90 between outer vessel 22 and interior vessel 28 through bores 86 to swirl in a turbulent spiral pattern into void 36, thereby increasing the discharge of dry particulate from within void 36 out through outlet 40. Testing showed that, if bores 86 were not angled and tangential, but instead were parallel to the longitudinal diameter of apparatus 20, only about 82% of the dry particulate was discharged from within void 36. When bores 86 were changed to be angled at 45 degrees and tangential so as to cause the pressurized gas passing from the space 90 between outer vessel 22 and interior vessel 28 through bores 86 to swirl in turbulent spiral pattern into void 36, the dry particulate discharge increased to about 90%. It was also observed that the apparatus 20 achieved a 92% discharge of dry particulate when in a horizontal position (i.e., neither upright nor inverted) when bores 86 were angled at 45 degrees and tangential. There are preferably sixty-eight bores 86, each 0.062 inch (0.157 cm) in diameter, arranged in three concentric circles as shown in FIG. 6. An alternate embodiment 80' of the plate is shown in FIG. 9, having eighty-six bores 86', each 0.031 inch (0.079 cm) in diameter, arranged in four concentric circles. For the alternate embodiment 80' of the plate, the central hole 84' is slightly smaller (1.00 inch (2.54 cm) in diameter, and the outer diameter of fitting 66 of fill valve assembly 64 is likewise correspondingly smaller, to accommodate the four concentric circles into which bores 86' are arranged. Because of the pressure gradient during discharge between the gas in space 90 between outer vessel 22 and interior vessel 28 due to the constriction of bores 86 (and 86' in the alternate embodiment), the gas emerges through the bores at high velocity in a swirling pattern of turbulence within void 36, thereby encouraging the dry powder particulate to be swept out through the outlet 40.

Apparatus 20 may also preferably be provided with a pressure switch fitting 92 in communication with the interior of outer vessel 22, with a well-known pressure switch 94 being received into fitting 92 and connected as by wires 96 to monitoring circuitry (not shown) for ensuring that there is sufficient pressure within apparatus 20 for correct operation.

After apparatus 20 has been assembled as described above, and has been pressure tested to ensure that there are no leaks, fill valve assembly 64 is removed from the apparatus and interior vessel 28 is filled with particulate 98, such as well-known dry powder fire extinguishing material, through inlet 62. Fill valve assembly 64 is then screwingly fitted into inlet 62 in second end 26 so as to seal the apparatus, and the apparatus is then pressurized to about 220 to 225 pounds per square inch (7.46 to 7.63 kg per square meter) of nitrogen through Schrader valve 70, and valve cap 72 is fitted onto the Schrader valve. When the single-action discharge valve 42 is actuated, the apparatus 20 will discharge the particulate 98 through outlet 40.

As a comparison of the present invention with the same structure but without interior vessel 28, plate 80, and outlet manifold 48 (i.e., the configuration of the prior art without the features of the present invention), over 95% of the particulate was discharged when the apparatus 20 was in the non-inverted position, about 60% of the particulate was discharged when the apparatus was in the inverted position, and about 64% of the particulate was discharged when the apparatus was in a horizontal position. This compares to the present invention with interior vessel 28, plate 80, and outlet manifold

48 showing a discharge of about 90% or greater when in the upright position, inverted position, or horizontal position.

INDUSTRIAL APPLICABILITY

The apparatus of the present invention is used to rapidly discharge particulate, such as dry powder fire extinguishing material, from within a pressurized vessel when the apparatus is in multiple orientations (non-inverted, inverted, or horizontal), producing improved completeness of discharge of particulate, regardless of the orientation, as compared with the prior art.

Although the present invention has been described and illustrated with respect to a preferred embodiment and a preferred use therefor, it is not to be so limited since modifications and changes can be made therein which are within the full intended scope of the invention.

I claim:

1. A multiple orientation particulate discharge apparatus, said apparatus comprising:

(a) an outer vessel having a first end and a second end;

(b) an interior vessel within said outer vessel, said interior vessel forming a void therewithin and said interior vessel being substantially sealed to said outer vessel proximate said first end; said outer vessel having an outlet through said first end in communication with said void;

(c) a single-action discharge valve selectively sealing said outlet;

(d) an outlet manifold within said interior vessel spanning said outlet and interposed between said valve and said void; said outlet manifold having a cap and having a plurality of radial passageways interposed between said cap and said first end, said plurality of radial passageways causing said outlet to be in communication with said void; and (e) a substantially planar plate proximate said second end and interposed between said outer vessel and said interior vessel, said plate having a center and having a plurality of bores therethrough, each bore of said plurality of bores having a bore axis and extending through said plate, a plane perpendicular to a line extending within said plate from said center of said plate to said bore axis of said plurality of bores, said bore axis of each said bore of said plurality of bores being within said plane at an acute angle with respect to said plate;

said apparatus having an inlet extending into said void through said outer vessel, said inlet being selectively sealed; and said interior vessel being filled with a particulate and said interior and said exterior vessels being pressurized.

2. The apparatus as recited in claim 1, in which said outlet has an outlet cross-sectional area and said plurality of radial passageways together have a total passageway cross-sectional area that is not less than said outlet cross-sectional area.

3. A multiple orientation particulate discharge apparatus, said apparatus comprising:

(a) an outer vessel having a first end and a second end;

(b) an interior vessel within said outer vessel, said interior vessel forming a void therewithin and said interior vessel being substantially sealed to said outer vessel proximate said first end; said outer vessel having an outlet through said first end in communication with said void;

(c) a single-action discharge valve selectively sealing said outlet;

(d) an outlet manifold within said interior vessel spanning said outlet and interposed between said valve and said void; said outlet manifold having a cap and having a plurality of radial passageways interposed between said cap and said first end, said plurality of radial passageways causing said outlet to be in communication with said void; and (e) a substantially planar plate proximate said second end and interposed between said outer vessel and said interior vessel, said plate having a plurality of bores therethrough arranged in a multiplicity of concentric circles, each bore of said plurality of bores having a bore axis and extending through said plate, each concentric circle from said multiplicity of concentric circles defining a plane and further defining a circumference of a cylinder perpendicular to said plane, said bore axis of each said bore of the plurality of bores being tangent to one cylinder of the multiplicity of concentric circles at an acute angle with respect to said plate;

said apparatus having an inlet extending into said void through said outer vessel, said inlet being selectively sealed; and said interior vessel being filled with a particulate and said interior and said exterior vessels being pressurized.

4. The apparatus as recited in claim 3, in which said outlet has an outlet cross-sectional area and said plurality of radial passageways together have a total passageway cross-sectional area that is not less than said outlet cross-sectional area.

* * * * *